US006138615A

United States Patent [19]

Boisset et al.

[11] Patent Number: 6,138,615

[45] Date of Patent: Oct. 31, 2000

[54] DEVICE FOR IMPROVING THE COMBUSTION OF A FUEL

[76] Inventors: Jean-Louis Boisset, Preignant, 19510 Salon la Tour; Patrick Jean Georges Siegler-Lathrop, 44 bis rue Pasquier, 75008 Paris, both of France

[21] Appl. No.: 09/227,334

[22] Filed: Jan. 8, 1999

Related U.S. Application Data

[63] Continuation of application No. PCT/FR97/01235, Jul. 8, 1997.

[30] Foreign Application Priority Data

Jul. 8, 1996 [FR] France ..... 96 08708
Mar. 28, 1997 [FR] France ..... 97 03870

[51] Int. Cl.[7] ..... F02B 51/00; F02M 27/00

[52] U.S. Cl. ..... 123/3; 123/536; 123/537; 48/144; 48/203; 48/219

[58] Field of Search ..... 123/536, 537, 123/538, 539; 48/144, 203, 219

[56] References Cited

U.S. PATENT DOCUMENTS

| | | | |
|---|---|---|---|
| 2,064,561 | 12/1936 | O'Sullivan . | |
| 2,999,485 | 9/1961 | Lundy | 123/537 |
| 3,653,364 | 4/1972 | Bogan | 123/3 |
| 3,816,083 | 6/1974 | Patterson | 48/59 |
| 3,989,477 | 11/1976 | Wilson et al. | 48/144 |
| 4,011,843 | 3/1977 | Feuerman | 123/537 |
| 4,276,131 | 6/1981 | Feuerman | 205/342 |
| 4,494,487 | 1/1985 | Nixon . | |
| 4,858,582 | 8/1989 | Brown | 123/523 |
| 5,074,273 | 12/1991 | Brown | 123/538 |

FOREIGN PATENT DOCUMENTS

| | | |
|---|---|---|
| 953246 | 12/1949 | France . |
| 1057064 | 3/1954 | France . |

*Primary Examiner*—Tony M. Argenbright
*Assistant Examiner*—Hai Huynh
*Attorney, Agent, or Firm*—Young & Thompson

[57] ABSTRACT

A device improving the combustion of a fuel by a gaseous oxidant includes a fuel intake, an oxidant intake and apparatus for keeping naphthalene in solid form in the gaseous oxidant intake to load it with naphthalene vapors as it flows towards the combustion chamber. The apparatus for keeping the naphthalene in the gaseous oxidant current includes a cartridge filled with naphthalene and having apertures forcing the oxidant gas to pass through it directly along a direction coinciding with that of the flow of the oxidant gas to the combustion chamber.

13 Claims, 2 Drawing Sheets

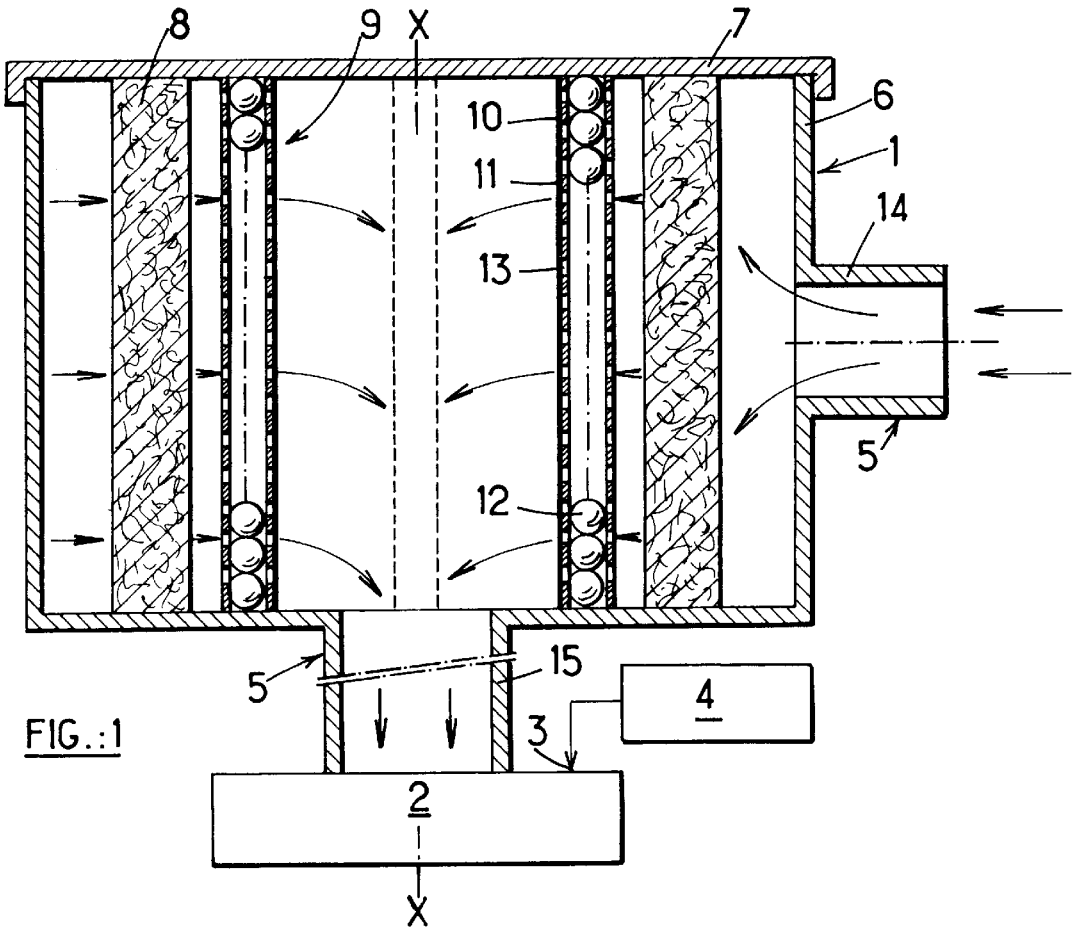
FIG.:1
FIG.:2
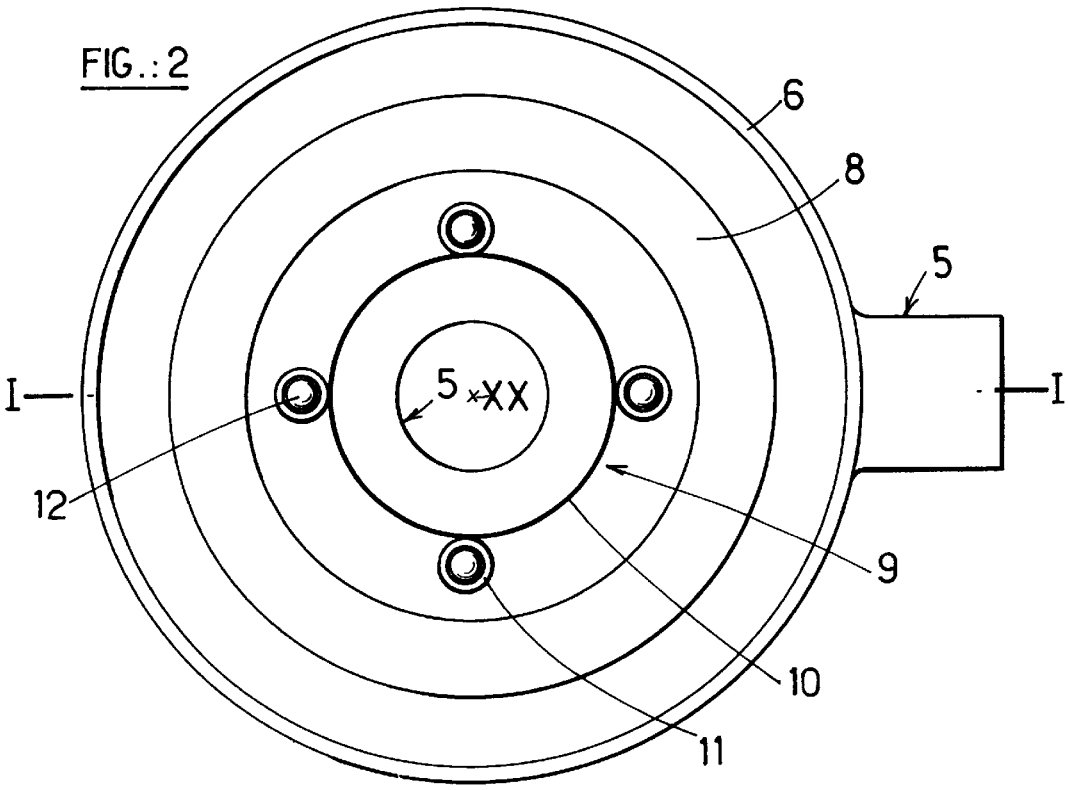

DEVICE FOR IMPROVING THE COMBUSTION OF A FUEL

This application is a continuation of international application PCT/FR97/01235 filed Jul. 8, 1997, which designed the United States.

The present invention concerns improving the combustion of certain fuels such as hydrocarbons.

To be more precise, the invention concerns improving the combustion of hydrocarbons or other similar fuels, in particular in apparatus such as internal combustion engines or heating burners, in particular with a view to reducing pollution, as much by reducing consumption as by intrinsic improvement in combustion.

U.S. Pat. No. 2,064,561 has already proposed adding to an internal combustion engine a device for evaporating a solid chemical substance which, when evaporated, is mixed with the oxidant air to be burned with the usual fuel, for example petrol or diesel.

The chemical substance employed is naphthalene which has a beneficial effect on the operation of an internal combustion engine, as specialists have known for a very long time.

In the aforementioned document the naphthalene is placed in the form of solid balls in a container the entry of which communicates with the atmosphere and the exit from which leads into the carburettor of the internal combustion engine. Accordingly air aspirated by the engine sweeps through the naphthalene which vaporizes to mix with the air before it enters the cylinders to assure combustion of the mixture comprising air charged with naphthalene and fuel.

The shape of the container is specifically designed to encourage evaporation of the naphthalene and its mixing with the oxidant air.

The air-naphthalene mixture is heated by the exhaust pipe for gases burned in the engine which passes through the container upstream of its outlet.

The combustion improving device described in the above prior art patent has a number of drawbacks. Firstly, the container must be especially attached to the internal combustion engine and therefore has a high additional cost increasing the unit cost of the engine. Also, filling the container with naphthalene is difficult for an unskilled person with the result that this filling must be entrusted to a garage mechanic. Finally, the design of the container does not allow efficient sweeping of the naphthalene balls and because the flow of air follows a sinuous path it offers a significant resistance to such flow on its path towards the inlet manifold of the engine.

An aim of the invention is to overcome the drawbacks of the prior art device described in the aforementioned patent.

The invention therefore consists in a device for improving combustion in apparatus for burning a fuel with the aid of a oxidant gas and including a fuel inlet and a oxidant gas inlet, said device comprising means for holding solid naphthalene in said oxidant gas inlet in order to charge it with naphthalene vapour as it flows towards said apparatus, the improved device being characterized in that said means for holding the naphthalene in the current of oxidant gas comprises at least one cartridge filled with naphthalene and having openings constraining at least some of the oxidant gas to flow through it directly in a direction coinciding with the direction of flow of the oxidant gas towards said apparatus.

Because the device in accordance with the invention defines a direct path for flow of the gaseous fuel from its first point of arrival, it offers only a very low resistance to such flow towards the combustion area and can therefore be applied profitably and efficiently to improving the combustion of hydrocarbons, in particular in internal combustion engines and in central heating burners, although the invention is not limited, to these two specific applications.

In accordance with another feature of the invention said cartridge is mounted on a support, preferably a removable support, disposed in said oxidant gas inlet.

In accordance with another feature of the invention said support is in the form of a mesh to which said cartridges are fixed and which is mounted in said oxidant gas inlet.

In accordance with another feature of the invention each cartridge is in the form of a tube with openings in it and filled with naphthalene balls. In this case, the inside diameter of the tube is advantageously slightly greater than the diameter of the naphthalene balls.

In accordance with another feature of the invention said openings are disposed in two diametrically opposite rows in the direction of the current of oxidant gas and the respective openings of the rows are aligned in pairs.

In accordance with another feature of the invention the quantity of naphthalene in the device is determined so that the oxidant gas is charged with naphthalene in an amount not exceeding 5 mg per liter of oxidant gas passing through the device when said apparatus is operating.

In accordance with one advantageous feature of the invention said cartridge is placed in a oxidant gas filter disposed in the oxidant gas inlet of said apparatus. This feature is particularly advantageous in the context of a motor vehicle internal combustion engine because the device of the invention can then be placed in the existing air filter of the engine.

In accordance with another feature of the invention the filter is of generally cylindrical shape defining an axis of symmetry of revolution and comprises a plurality of tubes equi-angularly distributed around said axis.

In accordance with a further feature of the invention an odorizing substance is mixed with the naphthalene.

Other features and advantages of the invention will become apparent from the following description given by way of example only and with reference to the accompanying drawings, in which:

FIG. 1 is a view in axial section of an air filter for an internal combustion engine, the filter incorporating a device in accordance with the invention;

FIG. 2 is a plan view of the filter from FIG. 1 with its cover removed.

Figure 3:
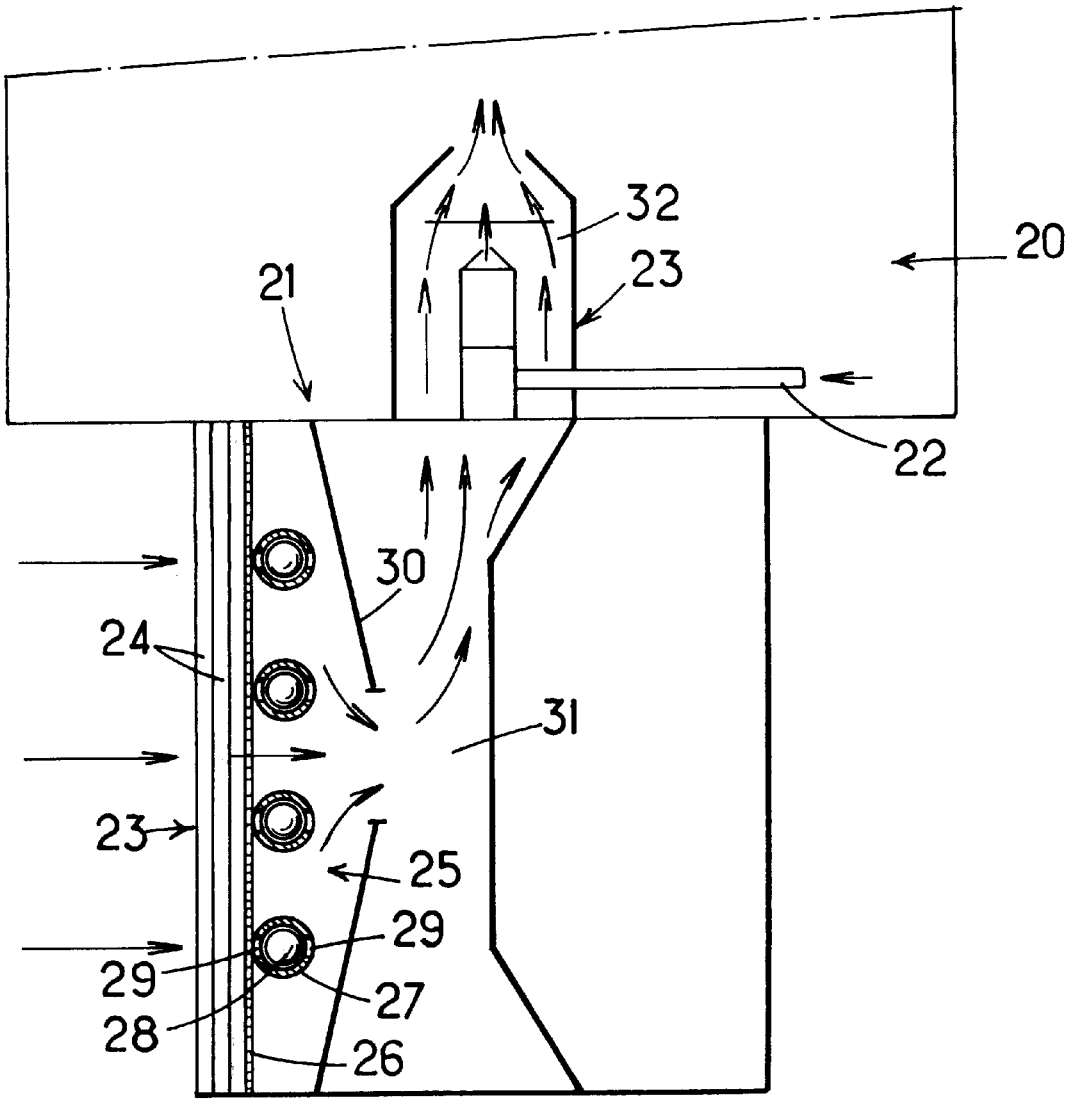
FIG. 3 is a diagrammatic plan view of a fuel oil burner, in particular a central heating burner, fitted with a device in accordance with the invention.

In the embodiment of the invention shown in FIGS. 1 and 2 the combustion improving device is used in a gas fuel filter 1 of an internal combustion engine. The engine is symbolized by the rectangle 2. It receives fuel at a fuel inlet 3 from a fuel tank 4.

The internal combustion engine can be of any type known in itself and equipped with any type of carburation system known in itself using a fuel made up of hydrocarbons. For example, all currently available petrol or diesel engines can be equipped with a device in accordance with the invention.

The filter 1 is connected in a oxidant gas inlet 5, the oxidant gas being air in most applications.

The filter 1 has a filter housing 6, here of generally cylindrical shape with an axis X—X, although this shape is not limiting on the invention. The housing 5 is closed by a cover 7 which clips onto the top edge of the housing 5, for example.

The housing 5 accommodates the usual filter element 8 which can be of any appropriate type, foamed plastics material being a typical material for this purpose. The element is in the form of a cylinder concentric with the axis X—X.

The device 9 for improving combustion (here for improving carburation of the internal combustion engine 2) comprises a support 10 that is also generally cylindrical in shape and which in the example has a diameter less than the smallest diameter of this filter element 8. The support 10 is therefore placed inside this filter element, although the converse arrangement is equally feasible. The support 10 is preferably in the form of a relatively fine mesh to confer the necessary stiffness on it without causing too great a head loss in the oxidant gas flowing through it.

The combustion-improving device 9 also comprises at least one circular section diffuser cartridge or tube 11 fixed to the support 9, its axis being parallel to the axis X—X of the filter 1. In the example the device 9 comprises four such diffuser tubes 11 equi-angularly distributed around the axis X—X. Each is filled with a certain number of naphthalene balls 12 the diameter of which is slightly less than the inside diameter of the tubes 11. Each tube has at least two rows of openings 13 in it aligned with the direction of flow of the current of gas fuel through the filter 1 when the engine 2 is operating. The openings 13 are preferably aligned in pairs transversely to the axis of each tube, the pairs being regularly distributed along the length of the tube.

The flow of gas fuel indicated by the arrows in FIG. 1 enters the filter 1 through an inlet tube 14 that is part of the gas fuel inlet 5 and communicates with the atmosphere. Its axis Y—Y is oriented radially relative to the axis of symmetry X—X of the filter 1. The gas current exits the filter 1 through an outlet tube 15 that is also part of the oxidant gas inlet 5 and is situated at the base of the filter to communicate with the inlet tube (not shown) of the engine 2.

In the embodiment shown in FIGS. 1 and 2 the device 9 is removable to facilitate recharging it after the naphthalene is consumed. To this end it is simply laid in the housing 6 and clamped axially by the cover 7 when the latter is clipped to the housing. As an alternative the improved device could equally be fixed permanently into the housing 6.

When the internal combustion engine 2 is operating the current of oxidant gas aspirated through the inlet 5 passes partly through the diffuser tubes 11 without being deflected from its normal path. It therefore sweeps through the naphthalene balls 12, encountering very little additional resistance to flow due to the tubes.

The naphthalene evaporates and charges the current of oxidant gas with a certain quantity of additive. The dimensions of the diffuser tubes 11 are chosen so that the oxidant gas is charged with evaporated naphthalene in an amount not exceeding 5 mg per liter of oxidant gas passing through the device 9 when the engine 2 is operating.

The naphthalene balls 12 preferably contain a certain proportion of an odorizing substance capable of masking and/or neutralizing the smell of naphthalene at least in part, the proportion being in the range 1% by weight to 3% by weight, for example, preferably around 1.2% by weight.

The combustion-improving device 9 described hereinabove can be used on any internal combustion engine equipping any kind of vehicle or apparatus (private motor vehicles, goods vehicles, agricultural tractors, earth-moving and other public works machines, lawnmowers, chainsaws, etc.).

It reduces fuel consumption, reduces carbon deposits and increases the service life of the component parts of the apparatus.

FIG. 3 shows a different application of the invention, this time to a central heating burner. The combustion chamber 20 of a boiler is equipped with a burner unit 21 comprising a fuel inlet 22, for fuel oil, for example, and an inlet 23 for a oxidant gas, which here is also air.

The oxidant gas inlet 23 includes a flowrate adjustment device 24 constituting its inlet. The adjustment device is not shown in detail; it can be formed in a manner known in itself by two discs, one of which can rotate and both of which include openings that can overlap to a greater or lesser degree according to the relative position of the discs to pass a metered quantity of oxidant air.

Downstream of the adjuster device 24 is an improved device 25 in accordance with the invention formed by a support 26 to which are fixed a plurality of diffuser cartridges or tubes 27 filled with naphthalene balls 28. The support 26 can be a mesh and the diffuser tubes 27 have openings 29 in them, the overall arrangement being similar to that described with reference to FIGS. 1 and 2, with the exception of course of the general shape of the device 25 which is flat rather than cylindrical. However, this general shape depends on the construction of the particular burner unit, FIG. 3 showing only one simple example in order to illustrate this application of the invention.

Upstream of the device 25 the oxidant gas is guided by deflectors 30 and the inlet 23 then leads through a flow chamber 31 to a mixing chamber 32 in which the fuel is sprayed from the inlet 22 before it is ignited at the outlet from the burner unit.

Note that in this embodiment of the invention the current of oxidant gas on its way to the mixing chamber 32 is charged with naphthalene vapour on passing through the diffuser tubes 27.

What is claimed is:

1. In combination an apparatus for burning of a fuel with the aid of an oxidant gas and having oxidant gas inlet, and a cartridge adapted to be placed in said oxidant gas inlet in such a manner as to constrain said oxidant gas to flow therethrough, said cartridge comprising a support permeable to said oxidant gas;

an at least one diffuser tube fixed to said support and defining a longitudinal axis, said diffuser tube comprising at least two rows of holes, said rows of holes extending longitudinally along said tube and having a diametrically opposed relationship, one of said rows of holes having a coexistent relationship with said support such that said oxidant gas, when flowing through said support, also flows partially through said diametrically opposed holes; and naphthalene balls disposed in said diffuser tube.

2. The combination of claim 1, wherein said oxidant gas inlet comprises an oxidant gas filter and wherein said cartridge is adapted to be placed within said filter.

3. The combination of claim 2, wherein said filter comprises a generally cylindrically shaped housing having an inlet and an outlet for the flow of said oxidant gas;

said support further comprising a generally cylindrical shape coaxially disposed in said housing between said inlet and said outlet; and said filter further comprises a generally cylindrical filter element coaxially disposed in said housing between said inlet and said outlet.

4. The combination of claim 3, wherein said support is removable from said housing.

5. The combination of claim 1, wherein said support is in the form of a mesh.

6. The combination of claim 1, wherein an inside diameter of said diffuser tube is slightly greater than a diameter of said naphthalene balls.

7. The combination of claim 1, wherein said diffuser tube is sized to hold a quantity of naphthalene balls so that the oxidant gas is charged with naphthalene in an amount not exceeding 5 mg liter of oxidant gas passing through the combination in operation.

8. The combination of claim 1, wherein said naphthalene balls comprise an odorizing substance.

9. A combustion improving device adapted for insertion into an oxidant gas inlet in order to charge the oxidant gas with a naphthalene vapor, said device comprising:

a cylindrical support;

a plurality of circular section diffuser tubes fixed to and equi-angularly spaced apart around said cylindrical support; and naphthalene balls disposed in said tubes.

10. The device of claim 9, wherein said tubes further comprise at least two rows of openings aligned in pairs transversely to an axis of said cartridges.

11. A combustion improving device adapted for insertion into a heating burner oxidant gas inlet in order to charge the oxidant gas with a naphthalene vapor, said device comprising:

a flat support adapted to be positioned adjacent the oxidant gas inlet;

a plurality of circular section diffuser tubes spaced apart and fixed to said flat support, said tubes comprising at least two rows of openings aligned in pairs transversely to an axis of said tubes; and naphthalene balls disposed in said cartridges.

12. The combustion improving device of claim 9, wherein said cylindrical support is a cylindrical mesh support.

13. The combustion improving device of claim 11, wherein said flat support is a flat mesh support.

* * * * *